US005994673A

United States Patent [19]

El-Shoubary et al.

[11] Patent Number: 5,994,673

[45] Date of Patent: Nov. 30, 1999

[54] VARIABLE VOLUME OVEN

[75] Inventors: Youssef El-Shoubary, N. Brunswick, N.J.; James Aaron White, Louisville, Ky.; Paul Alfred Siemers, Clifton Park, N.Y.; Mark Edward Dausch, Latham, N.Y.; Bang Mo Kim; Norman Zethward Shilling, both of Schenectady, N.Y.

[73] Assignee: General Electric Company, Schenectady, N.Y.

[21] Appl. No.: 08/887,655

[22] Filed: Jul. 3, 1997

[51] Int. Cl.[6] ..... A21B 1/22; F24L 15/16; H05B 3/68

[52] U.S. Cl. ..... 219/403; 219/394; 219/395; 219/409; 126/337 R; 126/337 A

[58] Field of Search ..... 219/385, 386, 219/390–394, 396, 399, 403, 409, 411, 521; 99/390–393, 396, 399; 126/19 M, 39 C, 337 R, 273 R, 337 A

[56] References Cited

U.S. PATENT DOCUMENTS

| | | | |
|---|---|---|---|
| 1,108,890 | 9/1914 | Davenport | 219/394 |
| 2,898,437 | 8/1959 | McFarland | 99/390 |
| 2,994,760 | 8/1961 | Pecoraro et al. | 219/394 |
| 3,176,118 | 3/1965 | Scott | 219/493 |
| 4,144,869 | 3/1979 | Oatley . | |
| 4,656,337 | 4/1987 | Lastofka et al. . | |
| 5,272,317 | 12/1993 | Ryu | 219/403 |
| 5,618,458 | 4/1997 | Thomas | 219/394 |

*Primary Examiner*—Joseph Pelham
*Attorney, Agent, or Firm*—David C. Goldman; Jill M. Breedlove

[57] ABSTRACT

A variable volume oven that can be modified to adjust its volume according to the cooking load. The volume of the oven is able to be adjusted by providing a heating element that is vertically adjustable within the oven to a position that provides better convective and radiative heating to the cooking load.

5 Claims, 5 Drawing Sheets

VARIABLE VOLUME OVEN

FIELD OF THE INVENTION

The present invention relates generally to an oven and more particularly to a variable volume oven.

BACKGROUND OF THE INVENTION

Reducing the amount of energy consumption in appliances such as an oven, is a significant problem, in part because a large amount of energy is needed to heat the oven, and in part because a large amount of energy is lost to the surrounding environment. Typically, only a small portion of an oven is used for cooking. However, cooking with a conventional oven requires that the entire volume be heated. There is no particular advantage to heating the entire volume of the oven. Heating the entire volume of the oven results in longer cooking times, which increases energy consumption. The longer cooking times and increased energy consumption associated with the conventional oven are further exacerbated by heat losses from radiative and convective heat through the chamber walls of the oven to the surrounding environment. Heat losses to the surrounding environment are approximately proportional to the hot interior surface area of the oven. Heat losses are rather large with conventional ovens because there is a generally large hot interior surface. In particular, the heat losses in a conventional oven may range anywhere from 50 percent to 90 percent. Accordingly, there is a need for an oven that can better direct radiative and convective heat towards the cooking load and minimize heat losses to the environment, in order to reduce energy consumption and heating time.

SUMMARY OF THE INVENTION

This invention is able to better direct radiative and convective heat towards the cooking load and minimize heat losses to the environment, by providing an oven that can be modified to adjust its volume according to the load, thereby reducing energy consumption and pre-heating time. The volume of the oven is able to be adjusted by providing a heating element that is vertically adjustable within the oven to a position that provides better convective and radiative heating to the cooking load.

Thus, in accordance with this invention, there is provided a variable volume oven. The oven comprises a chamber having a front wall, a rear wall, a pair of side walls, a top wall and a bottom wall. A plurality of supporting grooves are located along each of the side walls of the chamber. A first heating element is located below the top wall of the chamber, substantially extending from the front wall of the chamber to the rear wall of the chamber. A second heating element is located above the bottom wall of the chamber, substantially extending from the front wall of the chamber along one of the plurality of supporting grooves in each of the side walls of the chamber. The second heating element is vertically adjustable within the chamber, fitting in any one of the plurality of supporting grooves in each of the side walls of the chamber.

DETAILED DESCRIPTION OF THE INVENTION

Figure 1:
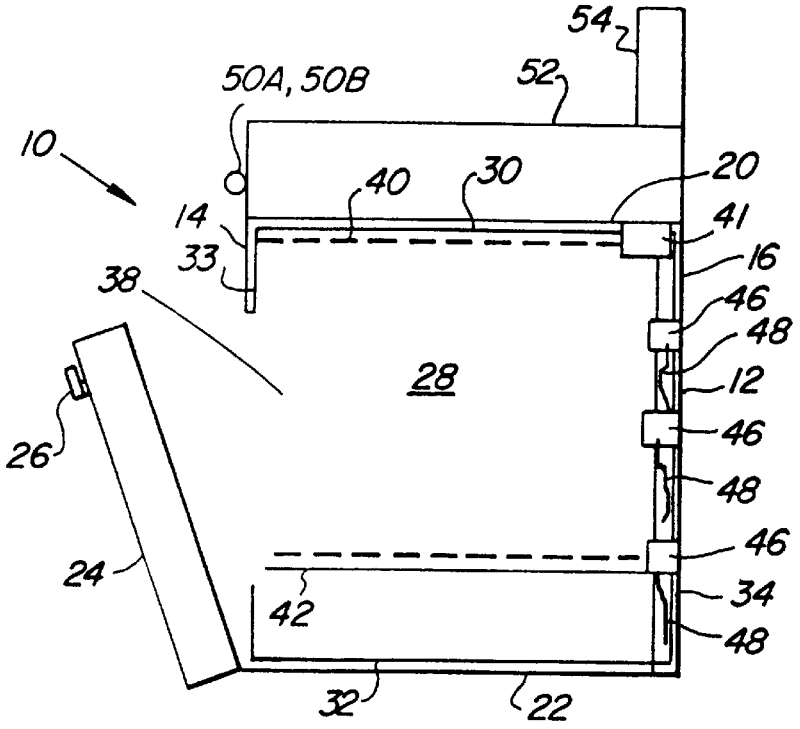
FIG. 1 is a side, elevational view of a first embodiment of a variable volume oven according to this invention.
Figure 2:
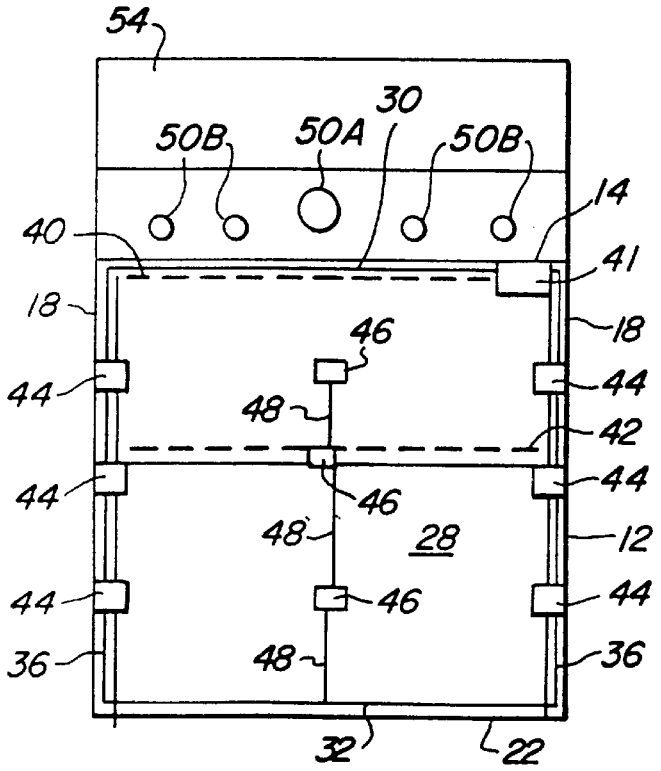
FIG. 2 is a front, elevational view of the oven shown in FIG. 1 without the oven door.

FIGS. 1 and 2 show a first embodiment of a variable volume oven 10 according to this invention. The oven 10 comprises a housing 12 having a front frame 14, a rear frame 16, a pair of side frames 18 spaced apart from each other by the front and rear frames, a top frame 20, and a bottom frame 22. Attached to the front frame 14 of the oven 10 is an oven door 24. The oven door is opened and closed using a handle 26 mounted on the door. Within the housing 12 is an oven chamber or cavity 28 having a top wall 30, a bottom wall 32, a front wall 33, a rear wall 34, and a pair of side walls 36 spaced apart from each other by the top, bottom, front and rear walls. An opening 38 is defined in the front wall 33. Food is inserted into the chamber 28 through the opening 38. The food is heated by a first heating element 40 and a second heating element 42. The first heating element 40 is located below the top wall 30 of the chamber 28, substantially extending from the front wall 33 to the rear wall 34 into a permanent mount 41 located about the rear wall. The second heating element 42 is located above the bottom wall 32 of the chamber 28, substantially extending from the front wall 33 to the rear wall 34. A plurality of supporting grooves 44 are located along each of the side walls 36 of the chamber 28. The plurality of supporting grooves 44 for each of the side walls 36 of the chamber 28 are vertically spaced apart from each at a predetermined distance. The second heating element 42 substantially extends from the front wall 33 along one of the plurality of supporting grooves 44 into one of a plurality electrical plugs 46 or bayonet mounts and electrical wiring 48 located about the rear wall 34 of the chamber 28. The plurality of electrical plugs 46 are vertically spaced apart from each at a predetermined distance. The second heating element 42 is vertically adjustable within the chamber 28, fitting in any one of the plurality of supporting grooves 44 in each of the side walls 36 and any one of the plurality of electrical plugs in the rear wall 34. The temperature of the first and second heating elements 40 and 42 are set with oven control knobs 50A located on the front frame 14 of the oven housing 12. A cooktop surface 52 with cooktop surface elements are located on the top frame 20 of the oven housing 14. The temperature of the cooktop surface elements are set with surface unit control knobs 50B. Also located on the rear of the cooktop surface 52 is a control panel background 54.

The vertically adjustable heating element 42 enables the volume of the oven 10 to adjust to the cooking load. For example, for larger items such as a turkey, a ham, or a roast, the heating element 42 would be positioned in the oven 10 in one of the lower supporting grooves 44 and lower electrical plugs 46. For smaller items requiring less room in the oven, the heating element 42 can be adjusted and moved to a higher positioned supporting groove 44 and electrical plug 46. The vertically adjustable heating element 42 enables the oven 10 to better direct the radiative and convective heat generated from both heating elements towards the cooking load. Since less volume of the oven needs to be heated, the chamber 28 is able to attain the set cooking temperature at a faster rate than a conventional oven having a fixed volume. A reduced cooking time results into reduced energy consumption. Reduction in energy consumption is even more pronounced with the variable volume oven 10, because there is minimal heat losses to the surrounding environment. Heat losses to the surrounding environment are minimized because the radiative and convective heat generated from the heating elements 40 and 42 are directed towards the cooking load, which reduces the amount escaping outside the oven.

Figure 3A:
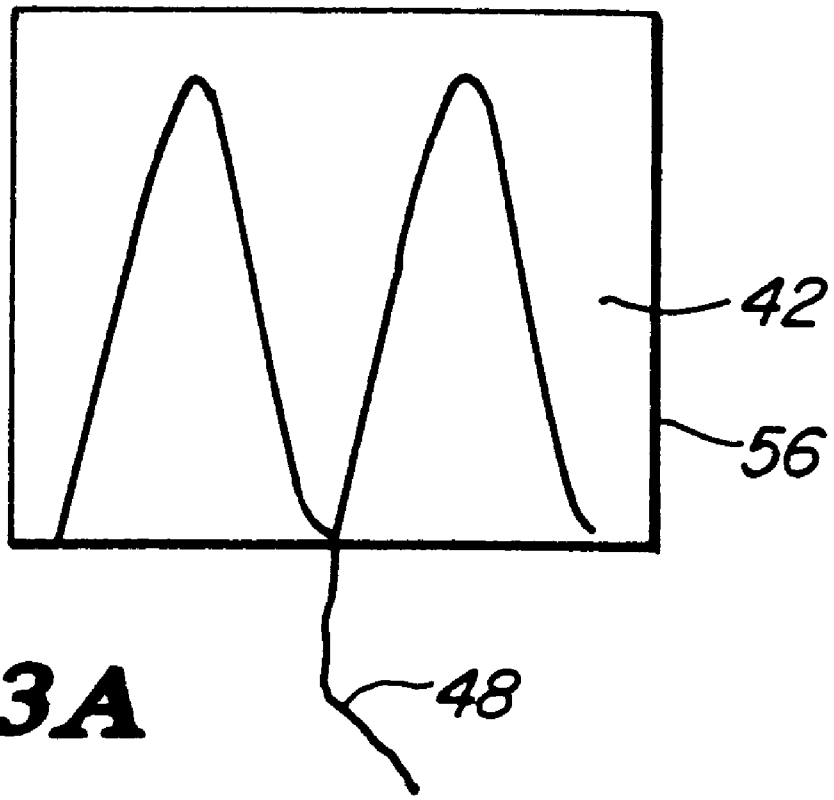
FIGS. 3*a*–3*b* are schematics of a top view and bottom view, respectively, of a heating element used in the variable volume oven according to this invention.
Figure 3B:
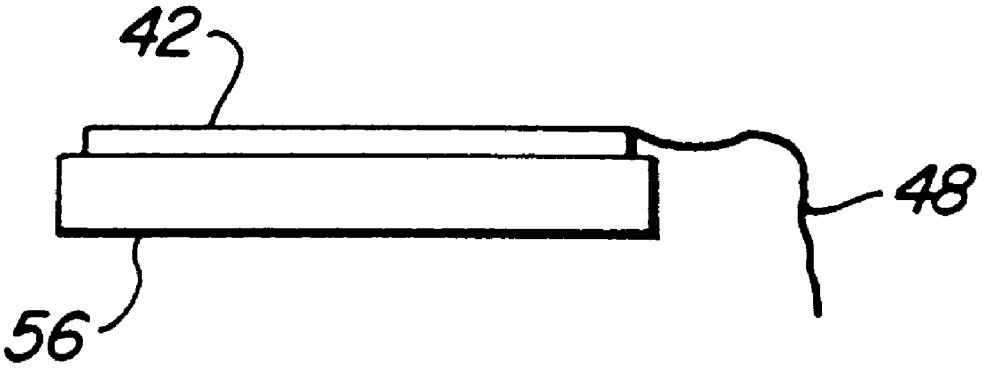

FIGS. 3*a*–3*b* are schematic diagrams of the second heating element 42. In particular, FIG. 3*a* is a top planar view of the second heating element 42 and FIG. 3*b* is a side, elevational view of the second heating element. In this invention, both the first heating element 40 and the second heating element 42 are electrical resistive heaters having a generally serpentine shape. The resistive heaters are preferably a tubular type made of nickel chromium wire in a metal sheath filled with magnesium oxide. To reduce heat losses, the heating elements are insulated with an insulating material 56 in the form of sheets or felts made of materials with low thermal conductivity such as alumina, glass, calcium silicates, and vermiculite.

Figure 4:
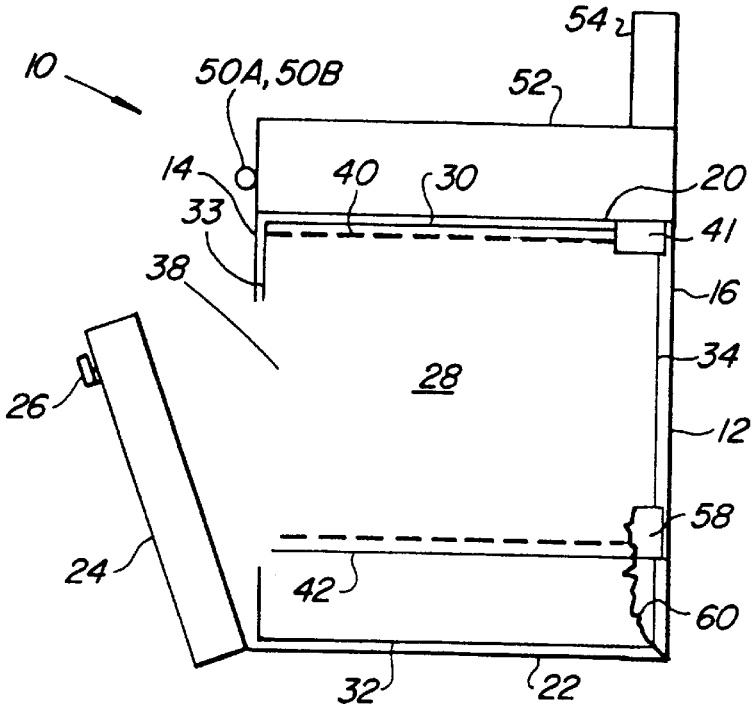
FIG. 4 is a side, elevational view of a second embodiment of the variable volume oven according to this invention.
Figure 5:
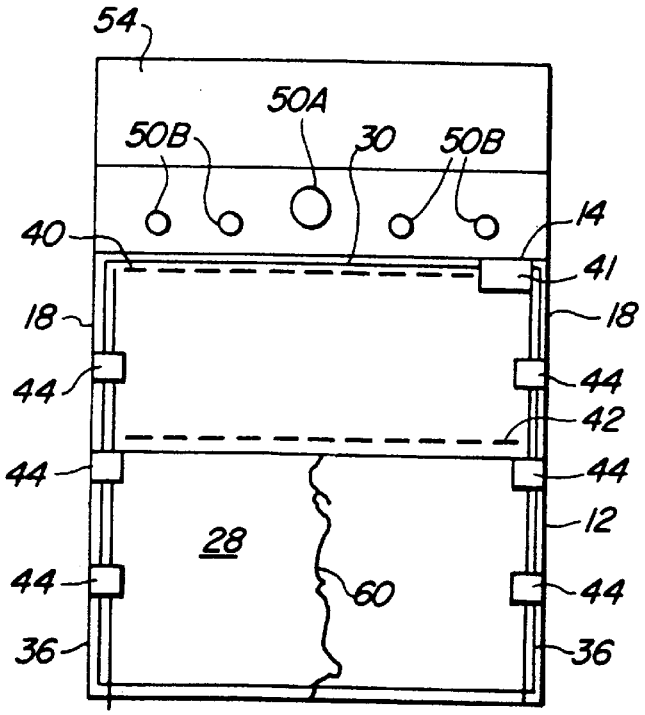
FIG. 5 is a front, elevational view of the oven shown in FIG. 4 without the oven door.

FIGS. 4 and 5 show a second embodiment of the variable volume oven 10. In this embodiment, the plurality of electrical plugs 46 for connection with the second heating element 42 at different positions have been removed from the variable volume oven 10 and have been replaced with a single electrical plug 58 and an extensible electrical wiring 60 connected directly to the heating element 42 and the electrical power. The extensible electrical wiring 60 is a preferably a longer coiled sheathed electrical wiring. As in the first embodiment, the second heating element 42 is vertically adjustable within the chamber 28, fitting in any one of the plurality of supporting grooves 44 in each of the side walls 36. As the second heating element 42 is adjusted vertically within the chamber 28, the extensible electrical wiring 60 moves accordingly with the heating element 42.

Figure 6:
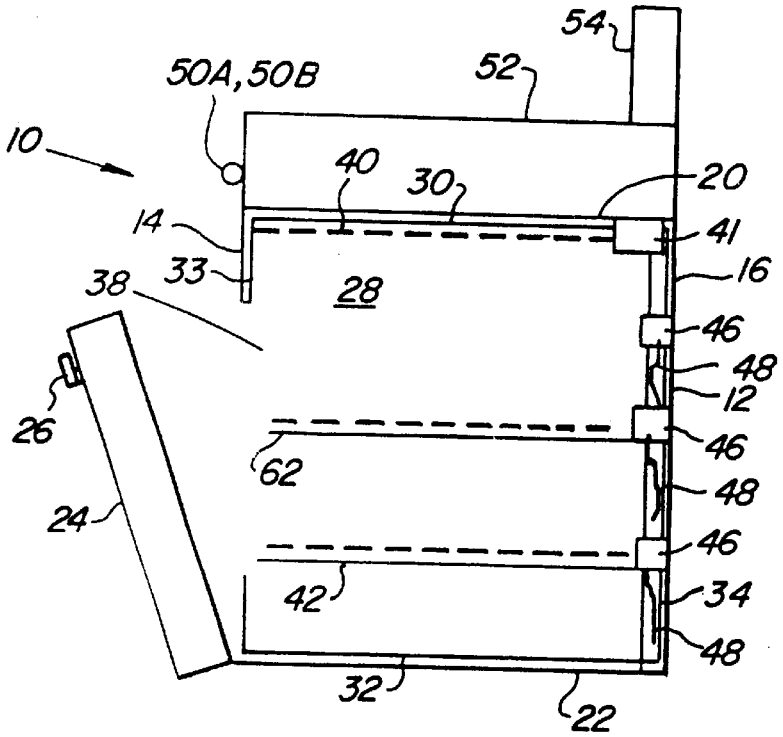
FIG. 6 is a side, elevational view of a third embodiment of the variable volume oven according to this invention.
Figure 7:
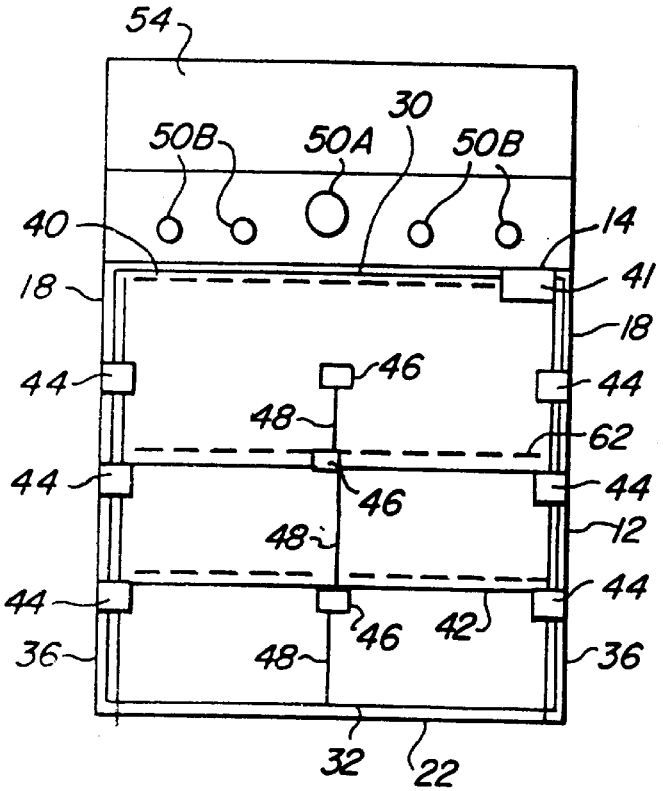
FIG. 7 is a front, elevational view of the oven shown in FIG. 6 without the oven door.

FIGS. 6 and 7 show a third embodiment of the variable volume oven 10. In this embodiment, a third heating element 62 has been added to create another independent oven within the variable volume oven 10. The third heating element 62 is located between the first heating element 40 and the second heating element 42, and substantially extends from the front wall 33 along one of the plurality of supporting grooves 44 into one of the plurality electrical plugs 46 and electrical wiring 48 located about the rear wall 34 of the chamber 28. As a result, one independent oven is formed between the first heating element 40 and the third heating element 62 and a second independent oven is formed between the second heating element 42 and the third heating element 62. The first oven and the second oven can be controlled by adding independent oven controls for each oven. The third heating element 62, like the second heating element 42 is vertically adjustable within the chamber 28, fitting in any one of the plurality of supporting grooves 44 in each of the side walls 36 and any one of the plurality of electrical plugs 46 in the rear wall 34.

The variable volume oven 10 of the first embodiment, the second embodiment and the third embodiment of this invention each provide significant reduction in energy consumption through various mechanisms. First, the variable volume oven 10 provides improved radiative heat transfer. Radiative heating involves infrared and longer wavelength electromagnetic component wavelengths that enable the oven to "brown" food. Typically, when broiling or baking, the direct radiative exposure of the cooking load to the heating elements improves as the distance of the load to the heating elements is reduced. By providing a vertically adjustable heating element within the chamber 28, the variable volume oven 10 is able to provide more direct radiative exposure to the cooking load and less direct radiative heat transfer from the first heating element 40, the second heating element 42, and the third heating element 62 to the internal walls of the chamber. Another mechanism as mentioned above, is that the variable volume oven 10 has less conductive heat losses to the ambient because the variable volume provides less of an internal hot area. A third mechanism for obtaining reduced energy consumption in the variable volume oven 10 is provided by the metal and equivalent thermal specific mass of the underlying insulation 56 in the second heating element 42 and third heating element 62. This enables the oven 10 to provide faster heating rate, which leads to reduced cooking time.

Figure 8:
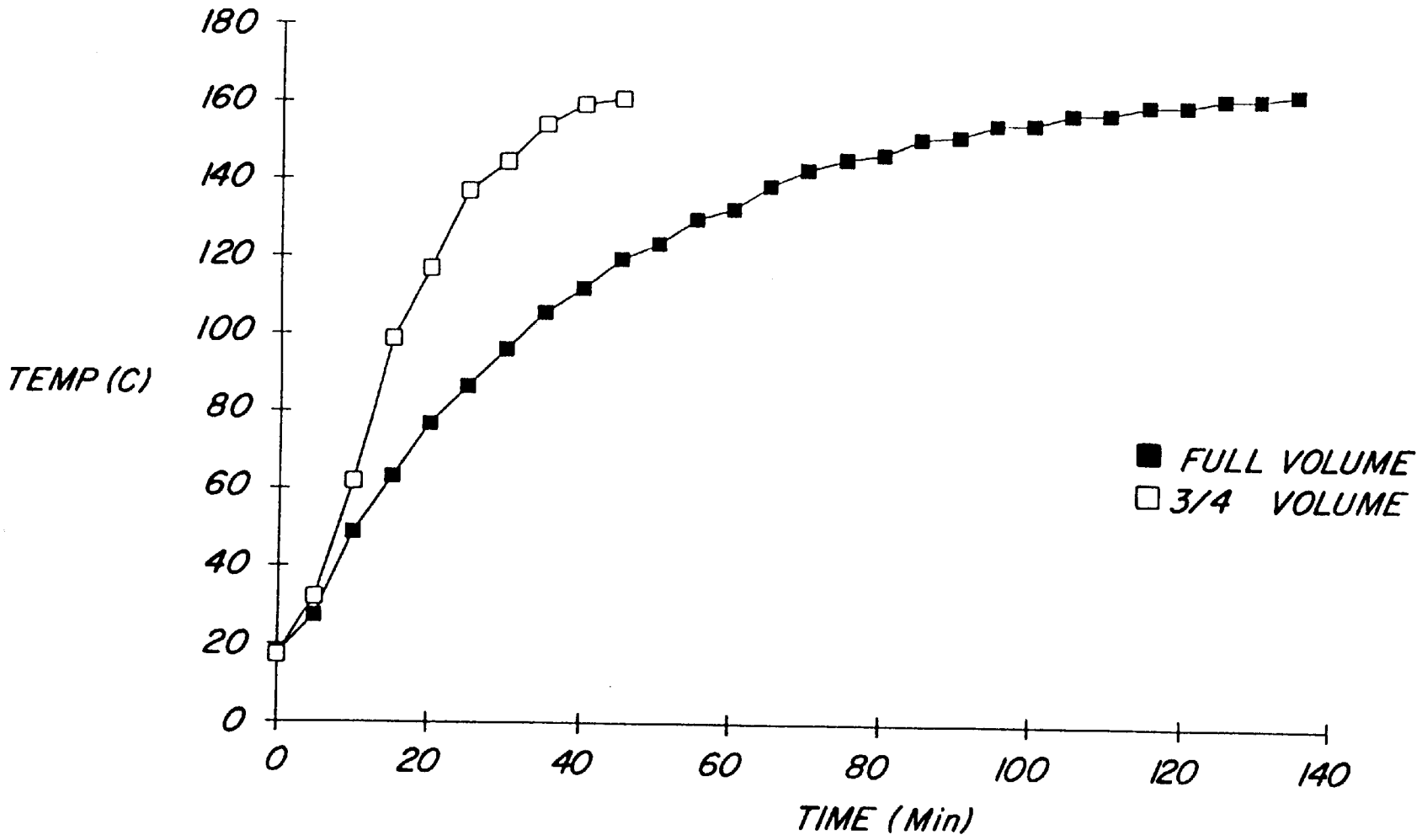
FIG. 8 is a graph showing a comparison of temperature increase for two different oven volumes.

FIG. 8 is a graph showing a comparison of temperature increase for two different oven volumes taken in an experiment in accordance with this invention. In the experiment, an aluminum block having a diameter of 6.25 inches (15.88 cm) with a thickness of 2.8 inches (7.11 cm) was heated in a commercially available house oven having an overall size of 17 inches by 23 inches by 16 inches (43.18 cm by 58.42 cm by 40.64 cm) at its full volume and at three quarters of the full volume. The temperature of the aluminum block was measured by inserting a thermocouple in the aluminum block. FIG. 8 shows that heating the block in the smaller volume oven resulted in a faster temperature increase than in the full volume oven. For example, it took 34 minutes to obtain a temperature of 150° C. (302° F.) in the smaller volume oven, while it took 84 minutes to reach the same temperature in the full volume oven. In addition to obtaining a faster temperature increase, the smaller volume oven used less energy than the full volume oven. For example, the smaller volume oven required 0.8 kWh of energy to reach a temperature of 160° C. (320° F.), while the full volume oven required 1.34 kWh of energy.

It is therefore apparent that there has been provided in accordance with the present invention, a variable volume oven. The invention has been described with reference to several embodiments, however, it will be appreciated that variations and modifications can be effected by a person of ordinary skill in the art without departing from the scope of the invention.

We claim:

1. A variable volume oven, comprising:

a chamber having a front wall, a rear wall, a pair of side walls, a top wall and a bottom wall;

a plurality of supporting grooves located along each of the side walls of the chamber;

a first heating element located below the top wall of the chamber, substantially extending from the front wall of the chamber to the rear wall of the chamber;

a second heating element located above the bottom wall of the chamber, substantially extending from the front wall of the chamber along one of the plurality of supporting grooves in each of the side walls of the chamber, the second heating element being vertically adjustable within the chamber, fitting in any one of the plurality of supporting grooves in each of the side walls of the chamber; and an extensible electrical wiring coupled to the second heating element, wherein the extensible electrical wiring varies vertically as the second heating element is adjusted within the chamber.

2. The oven according to claim 1, wherein the plurality of supporting grooves for each of the side walls of the chamber are vertically spaced apart from each at a predetermined distance.

3. The oven according to claim 1, further comprising a plurality of electrical plugs located about the rear wall of the chamber, each of the plurality of electrical plugs adaptable to connect with the second heating element.

4. The oven according to claim 3, wherein the plurality of electrical plugs are vertically spaced apart from each other at a predetermined distance.

5. The oven according to claim 1, further comprising a third heating element located between the first heating element and the second heating element, substantially extending from the front wall of the chamber along one of the plurality of supporting grooves in each of the side walls of the chamber, the third heating element being vertically adjustable within the chamber, fitting in any one of the plurality of supporting grooves in each of the side walls of the chamber.

* * * * *